US005704478A

United States Patent [19]

Born

[11] Patent Number: 5,704,478

[45] Date of Patent: Jan. 6, 1998

[54] CENTERING BUSH

[75] Inventor: Norbert Born, Blieskastel, Germany

[73] Assignee: Hoechst Aktiengesellschaft, Frankfurt am Main, Germany

[21] Appl. No.: 742,696

[22] Filed: Nov. 4, 1996

Related U.S. Application Data

[63] Continuation of Ser. No. 506,695, Jul. 25, 1995, abandoned.

[30] Foreign Application Priority Data

Jul. 28, 1994 [DE] Germany ..... 44 26 743.6

[51] Int. Cl.[6] ..... B65D 85/672

[52] U.S. Cl. ..... 206/394; 206/303; 206/391; 242/118.41; 53/409

[58] Field of Search ..... 206/391, 394, 206/303, 821; 242/118.41, 605; 53/409

[56] References Cited

U.S. PATENT DOCUMENTS

| | | | |
|---|---|---|---|
| 1,051,427 | 1/1913 | McCluskey | 242/118.41 |
| 2,957,601 | 3/1960 | Novick | 206/821 |
| 3,759,460 | 9/1973 | Fyans . | |
| 5,236,141 | 8/1993 | Kewin . | |
| 5,351,825 | 10/1994 | Duffy | 206/394 |

FOREIGN PATENT DOCUMENTS

WO 93/08112 4/1993 WIPO .

*Primary Examiner*—Jacob K. Ackun
*Assistant Examiner*—Luan K. Bui
*Attorney, Agent, or Firm*—Foley & Lardner

[57] ABSTRACT

A centering bush for connecting and centering winder cores which stand on one another. The centering bush, in one embodiment, has first and second cylindrical parts on both sides of a median plane, of which the first part lies above the plane, and the second part lies below the median plane. The first and second cylindrical parts are adjoined on both sides by parts that are conically shaped towards a median axis of the centering bush. Projections in the form of sharp-edged spikes with rounded ends are arranged on the outer circumference of the centering bush in the region of the median plane.

21 Claims, 3 Drawing Sheets

CENTERING BUSH

This application is a continuation of application Ser. No. 08/506,695, filed Jul. 25, 1995 and now abandoned.

BACKGROUND OF THE INVENTION

The invention relates to a centering bush for centering and connecting winder cores standing on one another, having at least one cylindrical part which extends on both sides of a median plane of the centering bush.

Centering bushes are used for connecting and centering the winder cores of wound rolls which stand on one another and are wound from any material, such as, for example, plastic film, metal foil, paper, textile and the like. Known centering bushes consist of a cylindrical body with a circumferential ring or bead. This bead prevents the centering bushes from sinking into the winder core into which they are inserted. In the case of this embodiment of the centering bush, the bead disadvantageously prevents the winder cores of wound rolls, which are stacked one above another, from standing directly on one another, instead they are separated by a gap. As a result of this gap between the wound rolls, there is a risk that the upper wound roll can telescope. In order to exclude this risk, the gap must be closed by means of filling material, such as corrugated board or similar material. As a result, the stability and the safety in transporting dispatch units of a plurality of wound rolls is also reduced and, in addition, additional packaging material is needed, which must be disposed of. As a result of packaging regulations in various countries, which prescribe minimum transport packaging, a requirement has been made for the receivers of packed goods, such as, for example, packed wound rolls which consist of films of narrow cut width, to keep the transport packaging as low as possible.

SUMMARY OF THE INVENTION

It is an object of the invention to produce a centering bush which improves the stability and transport safety of dispatch units consisting of wound rolls standing on one another and renders superfluous the use of additional transport packaging means.

According to the invention, this object is achieved by providing a centering bush With a median plane, a median axis, and at least one cylindrical part. The cylindrical part includes an outer circumference, and by its orientation, the cylindrical part extends on both sides of the median plane. The centering bushing further includes first and second conical parts provided on opposite sides of the median plane, and at least one sharp-edged projection arranged on the outer circumference of the cylindrical part.

According to the invention, this object is further achieved in the manner that the centering bush is conically shaped on both sides of the cylindrical part, and that sharp-edged projections with ends that are rounded-off are arranged on the outer circumference of the cylindrical part.

In a refinement of the invention, the at least one cylindrical part and the conical parts which are adjacent thereto and on both sides of the at least one cylindrical part are of hollow and closed design or structure, as a result of which a saving of material, and hence an associated saving in weight, are achieved.

In a further refinement, the at least one cylindrical part comprises cylindrical parts arranged on both sides of the median plane. The cylindrical parts merge into parts which are conically shaped toward the median axis. Also, sharp-edged spikes with rounded off ends are arranged on the outer circumference of the centering bush in the median plane as projections.

In one preferred embodiment, the outer diameter of the centering bush is, in the median plane, expediently equal to the internal diameter of the winder cores. In this arrangement, the ends of the spikes lie on a circle whose diameter is greater than the internal diameter of the winder cores.

Another objective of the invention is to provide a method of forming a dispatch unit of wound rolls. This objective is achieved by aligning a first winder roll with a winder core in a stacking orientation, inserting a centering bush with at least one projection into the winder core of the first winder roll, and stacking a second winder roll with a winder core onto said first winder roll without an air gap.

Additional objects and advantages of the invention will be set forth in the description which follows, and, in part, will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and, together with the general description given above and the detailed description of the preferred embodiments given below, serve to explain the principles of the invention.

The invention is explained in more detail below with reference to exemplary embodiments shown in drawings, in which.

DESCRIPTION OF THE PREFERRED EMBODIMENTS

Figure 1:
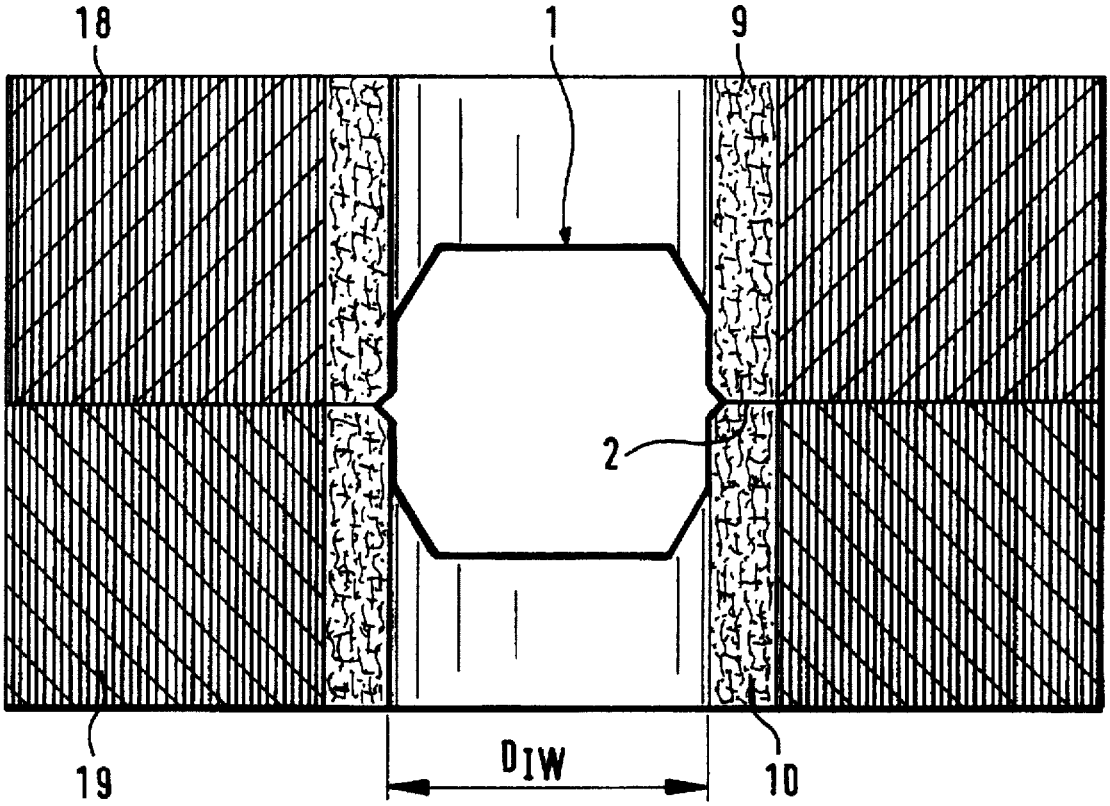
FIG. 1 shows, in a schematic sectional view, two wound rolls placed one above another and a first embodiment of a centering bush according to the invention which is fitted in between them.
Figure 2:
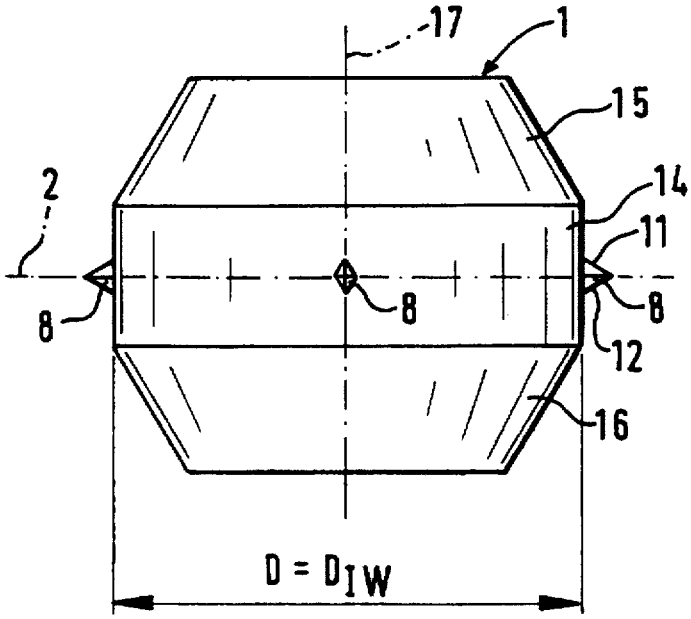
FIG. 2 shows a view of the first embodiment of the centering bush.

FIG. 1 shows, in a schematic sectional view, two wound rolls 18 and 19, which are placed one above another, and in each case have winder cores 9 and 10 of the same dimensions. The wound rolls 18 and 19 can be rolls on which material such as plastic films, metal foils, textile, paper or the like has been wound. The two wound rolls 18 and 19 form a so-called dispatch unit for transport. The two wound rolls are in contact along a median plane 2, are centered by means of a first embodiment of a centering bush 1, and secured against slipping. As shown in FIG. 2, the internal diameter of the winder cores 9 and 10 is equal to the greatest outer diameter D of the centering bush.

FIG. 2 shows a view of the centering bush 1, which consists of a cylindrical part 14, an upwardly adjoining conical part 15, and a downwardly adjoining conical part 16.

Sharp-edged projections 8 having rounded ends are arranged on the outer circumference of the cylindrical part 14, at the level of the median plane 2. The cylindrical part 14 extends symmetrically on both sides of the median plane 2 of the centering bush 1. As can be seen from the partially sectioned, perspective view of FIG. 3 of the centering bush 1, the cylindrical part 14 and the conical parts 15 and 16 which are adjacent thereto and on both sides of the cylindrical part, are of a hollow and a closed structure. In this arrangement, parts 14, 15, and 16 merge into one another without an intermediate wall.

Figure 3:
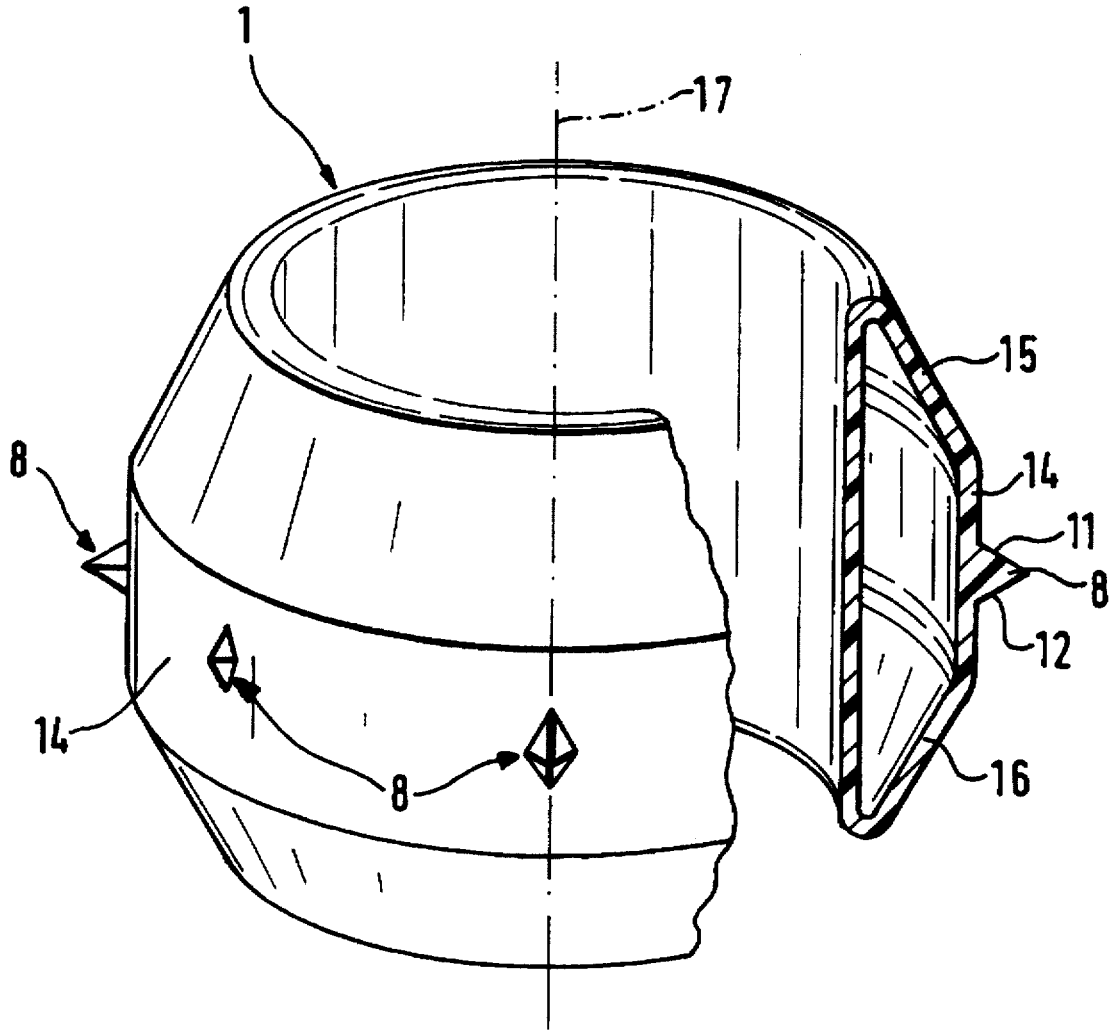
FIG. 3 shows a perspective view of the centering bush according to FIG. 2.

As can be seen from FIGS. 2 and 3, the projections 8 have sharp edges 11, 12 which extend at right angles to the median plane 2.

Using FIG. 1, it will be briefly explained how the centering bush 1 is inserted into the winder cores 9 and 10. The lower wound roll 19 is placed on end, that is, the winder core 10 is aligned vertically. The centering bush 1 is then inserted in a press fit into the winder core 10, so that the projections 8 rest on the upper edge of the winder core 10. The upper wound roll 18, likewise aligned on edge, is then placed onto the lower wound roll 19. As a result of the dead weight of the wound roll 18, the projections 8 in the median plane 2 are pressed into the two winder cores 10 and 9 located above one another. As a result, the production of an air gap in the median plane 2 between the wound rolls 18 and 19 is avoided. Furthermore, the centering bush 1 centers itself and, as a result of the press fit, the two wound rolls 18 and 19 are secured against slipping. The material of the winder cores 9 and 10 is generally cardboard, so that the sharp-edged projections 8 of the centering bush 1 can be pressed into the winder cores without problem. If the winder cores consist of hard material, for example, of plastics or metal, the core edges or margins are beveled, so that the projections in the median plane of the centering bush rest on the bevel, as a result of which there is a self-centering of the centering bush and securing of the winder cores against slipping.

For dispatch, the wound rolls are generally placed on end, and in the case of narrow formats or widths of the wound film sections, a plurality of wound rolls are placed on one another or stacked on one another. The winder cores which stand one above the other have the same dimensions. As soon as a wound roll is placed on end, a centering bush according to the invention is fitted into its winder core, which generally consists of cardboard, so that the projections in the median plane of the centering bush initially rest on an upper edge of the winder core. If a further wound roll is placed on this wound roll, then the sharp-edged projections or spikes of the centering bush sink into the winder cores, and are pressed into the winder cores as a result of the wound roll weight.

In the case of winder cores made of hard material, for example, from plastics or metal, the core edges or margins are beveled so that the projections in the median plane of the centering bush rest on the bevel. As a result of the projections resting on the band, the centering bush is centered, and the winder cores are secured against slipping.

As discussed above, by means of the invention, advantages are achieved in that the centering bush is self-centering. Moreover, as a result of the press fit of the projections or spikes into the material of the winder cores, the wound rolls are secured against slipping. Additionally a further advantage is that the two wound rolls sit closely on each other without a gap, so that telescoping of the upper wound roll is largely avoided. This is in contrast to known centering bushes in which there is always a gap between the wound rolls which are resting on each other, which gap favors the telescoping of the upper wound roll.

The centering bush according to the invention renders additional packaging material superfluous so that packaging material waste is largely reduced. The centering bush is also a reusable packing means, that is to say can be reused many times. High stability of the dispatch units of wound rolls and great transport security of these dispatch units result from the self-centering and the press fit of the centering bush.

Figure 4:
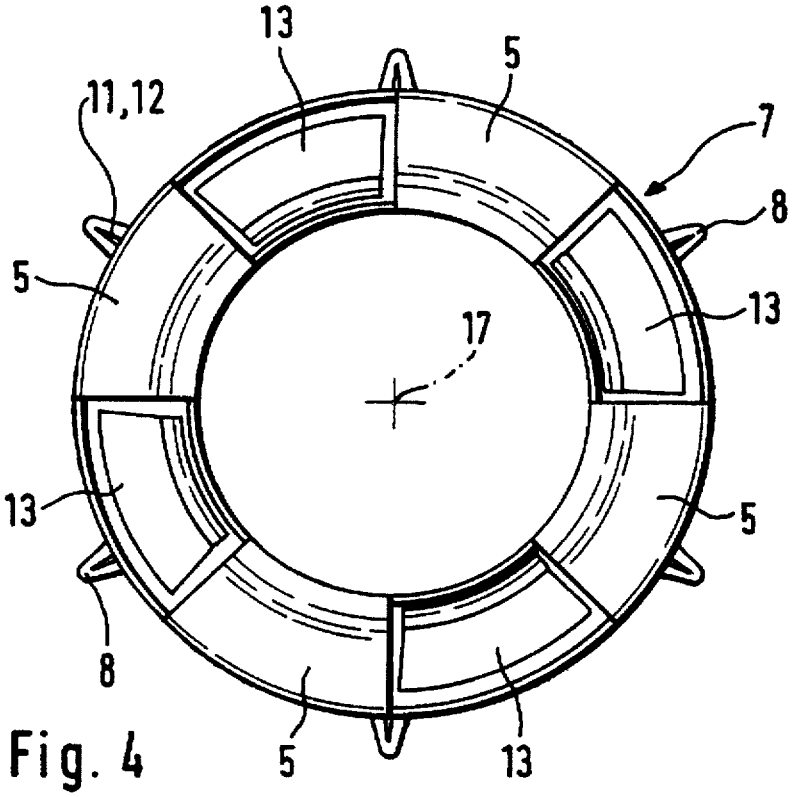
FIG. 4 shows a top view of a second embodiment of a centering bush according to the invention.

FIG. 4 shows a second embodiment of a centering bush 7 in which, by contrast with the first embodiment of the centering bush 1, a saving in material and weight is achieved. In the case of this centering bush 7, a plurality of cylindrical parts 3 and 4 are located on both sides of the median plane (not shown in FIGS. 4 and 5, yet similarly located as in FIG. 2), the parts located above the median plane being given the reference number 3 and the parts located below the median plane being given the reference number 4. Adjoining the cylindrical parts 3 and 4 are, respectively, in each case are parts 5 and 6. Parts 5 and 6 are conically formed toward the median axis 17 of the centering bush 7. Sharp-edged spikes 8 are arranged as projections on the outer circumference of the centering bush 7 in the median plane. The number of spikes is freely selectable, as in the case of the first embodiment of the centering bush, and being in general between six and twelve. In the preferred embodiment shown in FIG. 4, the centering bush is provided with six spikes. The ends of the spikes 8 lie on a circle whose diameter is greater than the internal diameter $D_{IW}$ of the winder cores. The ends of the spikes 8 are rounded-off to reduce the risk of injury. The fitting of the centering bush 7 is carried out in the same way as was described, using FIG. 1, for the first embodiment of the centering bush. The outer diameter D of the centering bush 7 in the median plane 2 is equal to the internal diameter $D_{IW}$ of the winder cores 9 and 10, just as in the first embodiment.

Figure 5:
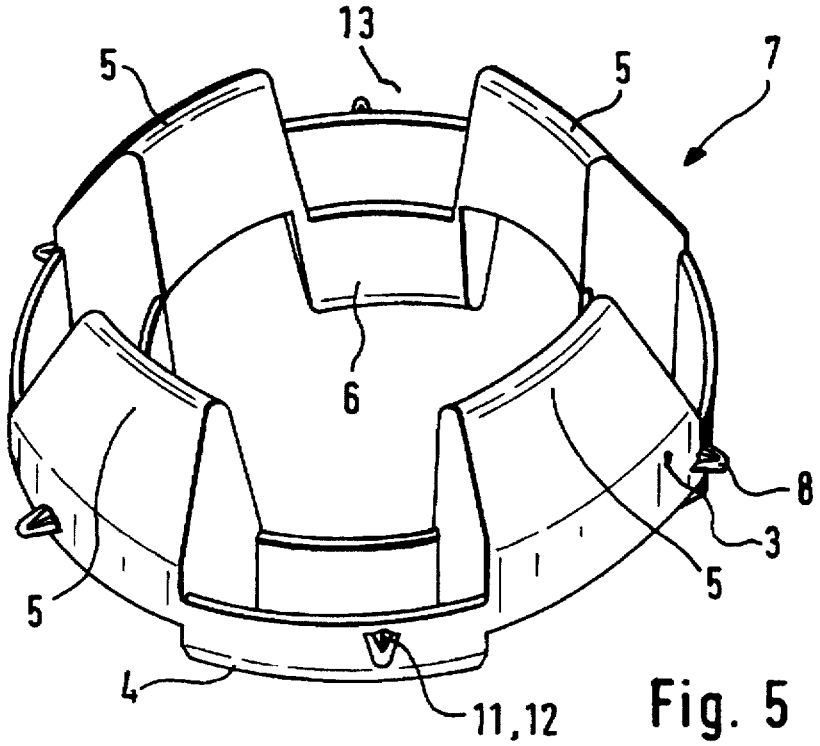
FIG. 5 shows a perspective view of the centering bush according to FIG. 4.

As can be seen from the perspective view of FIG. 5, the cylindrical parts 3 and 4, and the conical parts 5 and 6 connected thereto, are uniformly distributed over the circumference of the centering bush 7. Between each two adjacent parts 3 and 5, and, 4 and 6, respectively, there is a gap 13. In this arrangement, the cylindrical parts 3 and the conical parts 5 connected thereto, which are located above the median plane, are offset with respect to the cylindrical parts 4 and the parts 6 connected thereto, which are located below the median plane in such a way that a gap 13 and a cylindrical part and the conical part connected thereto, 3 and 5, and 4 and 6, respectively, lie alternately opposite one another.

The cylindrical parts and the conical parts connected thereto are of hollow structure, and the entire centering bush 7 is lighter than the first embodiment of the centering bush 1, because of the gaps 13 between the adjacent parts 3 and 5, and, 4 and 6, respectively. The centering bush 7 is formed in such a way that, as compared with the centering bush 1, it is no longer formed only from a narrow cylindrical body having conically beveled parts, but rather has horizontal and vertical surfaces as a result of the gap formation between the parts, which are connected to one another. These relatively large horizontal and vertical surfaces can be registered by means of optoelectronic means, so that the centering bush 7 is also particularly suitable for automatic insertion by means of robots into the winder cores.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A centering bush for centering and connecting winder cores standing on one another, said centering bush having a median plane and a median axis, and comprising:

at least one hollow annular part including an outer circumference and an inner surface, said hollow annular part extending on both sides of said median plane;

first and second hollow conical parts, each of said first and second hollow conical parts having an outer surface and an inner surface, said first and second hollow conical parts being adjacent to and on opposite sides of said at least one hollow annular part so that said first and second hollow conical parts and said at least one hollow annular part merge without an intermediate wall to form a hollow and self-closed structure with said inner surface of said at least one hollow annular part and said inner surface of each of said first and second hollow conical parts being aligned to define a cylindrical inner surface parallel with the median axis; and at least one sharp-edged projection arranged on said outer circumference of said at least one hollow annular part.

2. The centering bush of claim 1, wherein said at least one sharp-edged projection comprises a rounded-off end.

3. The centering bush of claim 1, wherein said first and second hollow conical parts are provide on opposite sides of said at least one hollow annular part so that said centering bush has conically shaped sides.

4. The centering bush as claimed in claim 1, wherein an outer diameter of said centering bush is, in said median plane, equal to an internal diameter of said winder cores.

5. The centering bush as claimed in claim 1, wherein the number of projections is at least six.

6. The centering bush as claimed in claim 1, wherein the number of projections is six.

7. The centering bush as claimed in claim 1, wherein said at least one sharp-edged projection has sharp edges at right angles to said median plane.

8. The centering bush for centering and connecting winder cores standing on one another, said centering bush having a median plane and a median axis, and comprising:

at least two hollow cylindrical parts, each including an outer circumference, and each of said two hollow cylindrical parts extending on opposite sides of said median plane;

first and second hollow conical parts provided on opposite sides of said median plane; and at least one sharp-edged projection arranged on said outer circumference of at least one of said at least two hollow cylindrical parts;

wherein said first and second hollow conical parts are adjacent to said at least two hollow cylindrical parts and are, respectively, on opposite sides of said at least two hollow cylindrical parts; and wherein each of said first and second hollow conical parts comprise a hollow structure open toward said median plane.

9. The centering bush as claimed in claim 8, wherein said at least two hollow cylindrical parts comprises first and second cylindrical parts arranged on both sides of said median plane; and wherein said first and second cylindrical parts, respectively, merge into said first and second hollow conical parts.

10. The centering bush as claimed in claim 9, wherein said first and second hollow conical parts are conically shaped toward said median axis; and wherein said at least one sharp-edged projection comprises a plurality of spikes with rounded-off ends arranged on an outer circumference of said first and second cylindrical parts in said median plane of said centering bushing.

11. The centering bush as claimed in claim 10, wherein an outer diameter of said centering bush is, in said median plane, equal to an internal diameter of said winder cores.

12. The centering bush as claimed in claim 10, wherein said ends of the spikes lie on a circle having a diameter greater than an internal diameter of said winder cores.

13. The centering bush as claimed in claim 9, wherein said first and second cylindrical parts, respectively connected to said first and said second hollow conical parts, are uniformly distributed over a circumference of said centering bush so that two adjacent said first hollow conical parts with said first cylindrical parts, respectively, connected and two adjacent said second hollow conical parts with said second cylindrical parts, respectively, connected form a gap therebetween.

14. The centering bush as claimed in claim 13, wherein said first cylindrical part and said first hollow conical part connected thereto are located on one side of said median plane, said second cylindrical part and said second hollow conical part connected thereto are located on an opposite side of said median plane and offset from said first cylindrical part, so that one of said gaps and one of said first and second cylindrical parts connected, respectively, with said first and second hollow conical parts connected thereto lie on opposite sides of said median plane.

15. A method of forming a dispatch unit of wound rolls, comprising the steps of:

aligning a first winder roll with a winder core in a stacking orientation;

inserting a centering bush with at least one projection into said winder core of said first winder roll, said centering bushing having first and second hollow conical parts that are located on opposite sides of and adjacent a hollow annular part so that said first and second hollow conical parts merge with said hollow annular part without an intermediate wall so that an inner surface of each of the first and second hollow conical parts aligns with an inner surface of said hollow annular part to define a cylindrical inner surface parallel with a median axis of the centering bush; and stacking a second winder roll with a winder core onto said first winder roll without an air gap.

16. The method of claim 15, wherein the step of inserting further comprises press fitting said centering bush into said first winder core so that said at least one projection rests on an upper edge of said winder core.

17. The method of claim 15, wherein the step of inserting further comprises inserting said centering bush with a plurality of sharp-edged spikes arranged on an outer circumference of said centering bushing as projections.

18. The method of claim 15, further comprising the step of providing an outer diameter of said centering bush equal to an internal diameter of said winder cores.

19. The method of claim 15, wherein the step of inserting further comprises inserting said centering bush into said winder core by a robot.

20. A method of forming a dispatch unit of wound rolls, comprising the steps of:

aligning a first winder roll with a winder core in a stacking orientation;

inserting a centering bush with at least one projection into said winder core of said first winder roll, said centering comprising at least two hollow cylindrical parts extending on opposite sides of a median plane of said centering bush, first and second hollow conical parts provided on opposite sides of said median plane, and at least one sharp-edged projection arranged on an outer circumference of at least one of said at least two hollow cylindrical parts so that said first and second hollow conical parts are adjacent to said at least two hollow cylindrical parts and are, respectively, on opposite sides of said at least two hollow cylindrical parts and each of said first and second hollow conical parts comprise a hollow structure open toward said median plane; and stacking a second winder roll with a winder core onto said first winder roll without an air gap.

21. The method of claim 20, further comprising providing said at least two hollow cylindrical parts as first and second cylindrical parts arranged on both sides of said median plane so that said first and second cylindrical parts, respectively, merge into said first and second hollow conical parts.

* * * * *